US005203800A

United States Patent [19]

Meredith

[11] Patent Number: 5,203,800

[45] Date of Patent: Apr. 20, 1993

[54] TREADMILL WITH PERIPHERAL BELT SUPPORT

[76] Inventor: Jeffrey O. Meredith, 3859 E. 8th St., Long Beach, Calif. 90804

[21] Appl. No.: 775,105

[22] Filed: Oct. 11, 1991

[51] Int. Cl.[5] ..... A63B 22/02

[52] U.S. Cl. ..... 482/54; 482/51

[58] Field of Search ..... 482/54, 51; 198/847, 198/842, 831

[56] References Cited

U.S. PATENT DOCUMENTS

| | | | |
|---|---|---|---|
| 1,016,729 | 2/1912 | Barrett | 482/54 |
| 2,017,885 | 10/1935 | Atcheson | 482/54 |
| 3,608,898 | 9/1971 | Berlin | 482/54 |
| 3,901,379 | 8/1975 | Bruhm | 198/831 |
| 3,917,092 | 11/1975 | McGinnis | 198/847 |
| 4,024,949 | 5/1977 | Kleysteuber et al. | 198/831 |
| 4,548,405 | 10/1985 | Lee et al. | 482/54 |
| 4,614,337 | 9/1986 | Schonenberger | 482/54 |
| 4,747,747 | 5/1988 | Fusco et al. | 198/847 |
| 4,955,466 | 9/1990 | Almes et al. | 198/842 |

*Primary Examiner*—Richard J. Apley
*Assistant Examiner*—Lynne A. Reichard
*Attorney, Agent, or Firm*—Pravel, Hewitt, Kimball & Krieger

[57] ABSTRACT

A treadmill with an endless belt forming a movable surface to walk or run on. The novel supports for the endless belt suspend it from the periphery of its uppermost surface. Two large rollers within the endless belt suspend it and allow it to be moved longitudinally. Two banks of small rollers mounted along the top edges of the frame form the lateral supports. These rollers engage the edges of the endless belt to suspend it laterally within the exercise area.

8 Claims, 3 Drawing Sheets

TREADMILL WITH PERIPHERAL BELT SUPPORT

BACKGROUND OF THE INVENTION

1. Field of the Invention

The present invention relates to treadmills. More specifically, the present invention relates to a treadmill with an endless belt that is suspended longitudinally and laterally, so that it can deflect downwards to absorb the impacts of a person walking or running on it.

2. Prior Art

Conventional treadmills provide a moving surface in the form of an endless belt traveling over a low friction surface between two rollers, so that a person can walk or run in a confined space. The low friction surface of the conventional treadmill is supported by a rigid unyielding frame. Sustained exercise of a type whereby the feet strike rigid, unyielding surfaces is popularly known as "high impact." High impact exercises have been proven to cause stress fractures, and other disabling injuries for some participants and many people cannot engage in any high impact activities because they could aggravate pre-existing conditions and/or hinder the rehabilitation of injuries.

Treadmills have been devised with yielding support structures under the endless belt such as the Treadmill Exercising Device with Yieldable Belt Support of Hagen U.S. Pat. No. 3,689,066 and the Exercise Treadmill Shock-Absorbing Improvement of Hanford U.S. Pat. No. 4,350,336. However, superior shock absorption capabilities are demonstrated by Lee et al with the Treadmill with Trampoline-Like Surface U.S. Pat. No. 4,548,405. This treadmill suspends the endless belt longitudinally between two rollers and laterally by a moveable spring suspension system over an essentially open frame. This complex suspension system supports the endless belt laterally by a plurality of springs attached along its edges. These springs are allowed to move with the endless belt by brackets containing rollers with anti-friction bearings that follow continuous tubular rails attached rigidly to the frame of the treadmill.

In the use of the Treadmill with Trampoline-Like Surface, it has been found that for best performance, the spring-carrying rollers must be made of a hard, low friction plastic such as acetal with Teflon®, and that the continuous rails be fabricated from a polished, seamless, corrosion resistant material such as high-grade stainless steel tubing. If inferior materials are used, the overall friction of the system becomes too great for a person to walk or run without the aid of a powerful electric motor. Additionally, a film of light oil must be maintained on these continuous railings to produce an acceptable level of mechanical efficiency.

The painstaking fabrication of these continuous railings, and the complexity of the spring-carrying roller brackets, results in a much higher cost of manufacture than conventional treadmills. Also, the continuous rails force the spring-carrying roller brackets to make 180 degree turns as they follow the endless belt at speeds up to 10 MPH. The rapid and constant nature of these directional changes gives the Treadmill with Trampoline-Like Surface a much higher operating noise level than any conventional treadmill, which is objectional in many health-care facilities.

SUMMARY OF THE INVENTION

The principal object of the present invention is to provide a device which duplicates the functionality of the Treadmill with Trampoline-Like Surface with a lateral support that is not continuous and therefore does not require the costly continuous support rails of the featured prior art.

It is also an object of the present invention to provide such a device that does not require lubricating oil to achieve the desired state of mechanical efficiency.

Another object of the present invention is to provide a device with significantly fewer parts than required in prior art, so that assembly, repairs, and maintenance can be carried out more expeditously.

An additional object of the present invention is to provide a device comprised of parts that can be made using less costly materials and methods of manufacture.

A further object of the present invention is to provide a device that is capable of operating at much lower noise levels than the Treadmill with Trampoline-Like Surface.

The foregoing objects can be accomplished by providing a treadmill with a peripheral support system for its endless belt. This treadmill uses two rotatable rollers to suspend its endless belt and allow it to move longitudinally. The endless belt is also suspended laterally from the edges of its uppermost surface as they engage two banks of small rollers fixed along both sides of the top of the frame.

In the preferred embodiment of the invention, the edges of the endless belt engage the two banks of rollers via guide brackets. These guide brackets attach directly to the edges of the endless belt without the springs of the featured prior art. Therefore, the depth of deflection of the endless belt when stepped on, depends solely on the materials used in its construction, and the weight and speed of the person running on the treadmill.

The frame of this treadmill rigidly supports the shafts for the two longitudinal support rollers as well as the two banks of lateral support rollers, without any structural members under the area of the endless belt used for exercising. This system gives peripheral support to the endless belt of the treadmill within the area adapted for exercise, thus allowing the endless belt to deflect downwards with the footfalls of someone walking or running on the treadmill without hitting any unyielding structures.

DETAILED DESCRIPTION OF A PREFERRED EMBODIMENT

Figure 1:
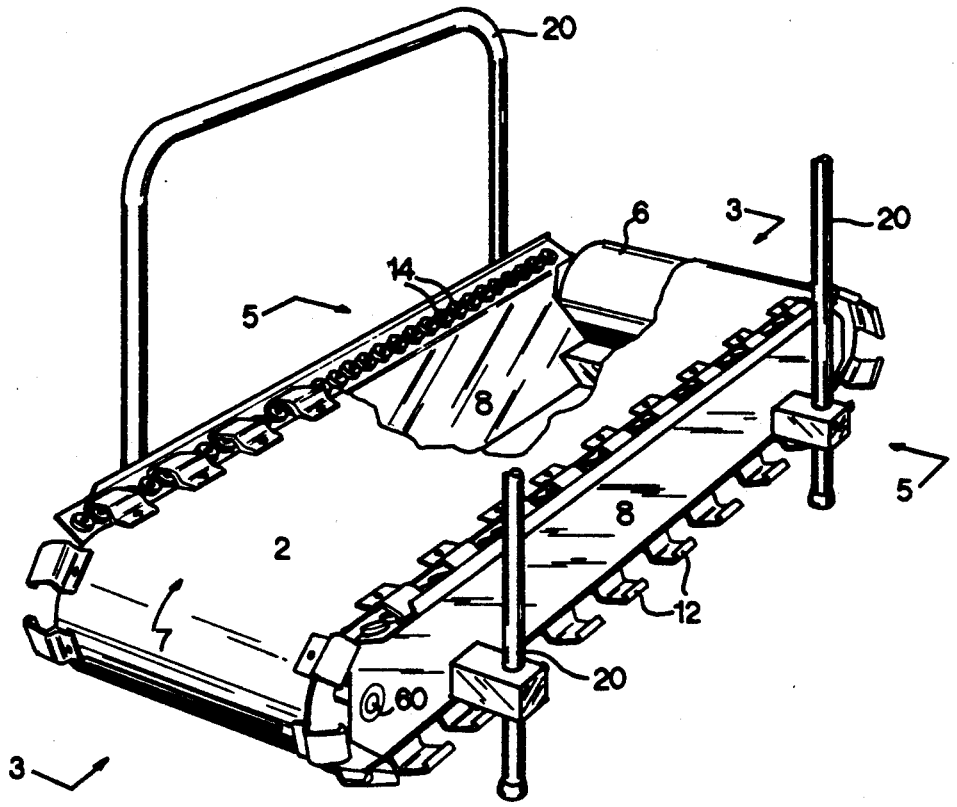
FIG. 1 is a perspective view of the treadmill which is the subject of the present invention with a partial cutaway to reveal the lateral support rollers and frame structure.

FIG. 1 shows the treadmill that is the present invention without an outer enclosure to conceal the moving parts. This enclosure is not shown to better illustrate the mechanism, but is intended as part of the preferred embodiment. The exerciser walks on the upper portion of the endless belt 2 which moves in the direction of arrow 7. Upright handrails 20 are provided to help the exerciser maintain his or her balance.

Figure 2:
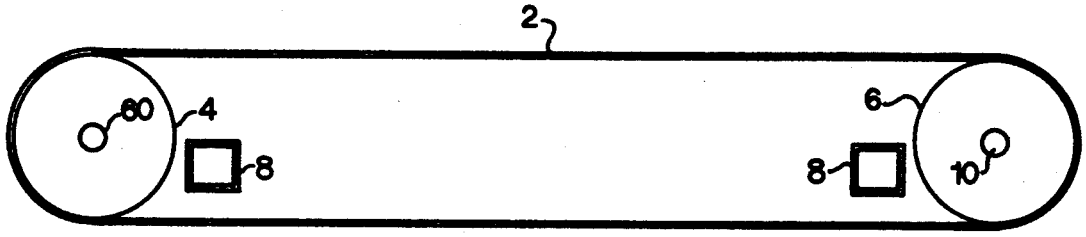
FIG. 2 is a sectional view of the treadmill in FIG. 1 taken along section line 3.

As shown in FIG. 2 rollers 4,6 with bearing fixed to the frame 8 support the endless belt 2 and allow it to move longitudinally. One of these rollers 4 can be driven by an electric motor coupled to shaft 60 or its rotational speed can be governed by coupling shaft 60 to a brake or similar device. The other roller 6 is an idler which simply moves with the endless belt 2. This idler roller 6 is supported on a shaft 10 that can be adjusted relative to the frame 8 to apply tension to the endless belt 2.

Figure 3:
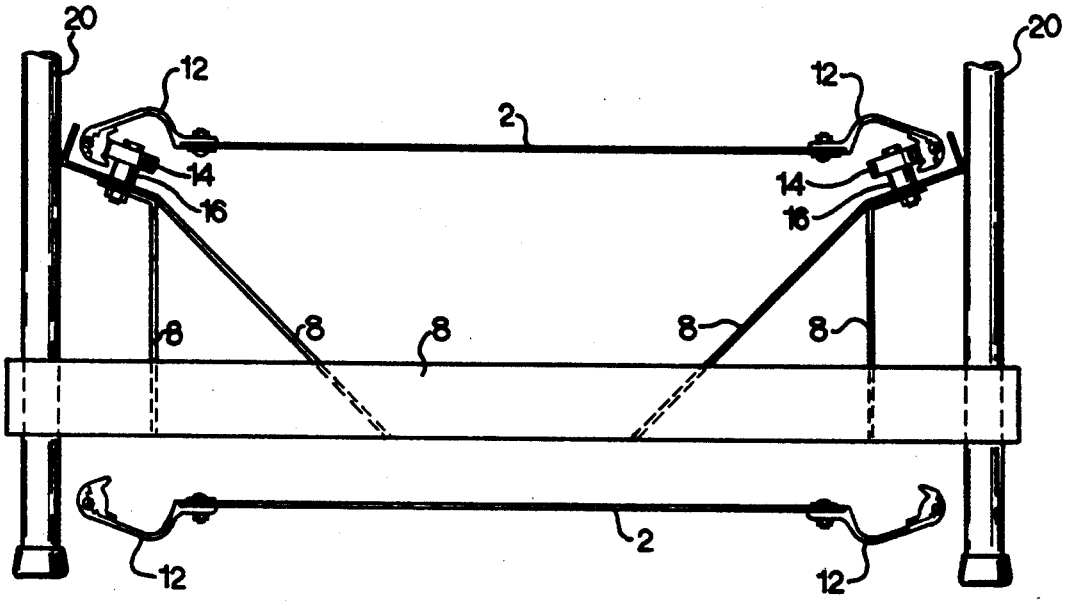
FIG. 3 is a sectional view of the treadmill in FIG. 1 taken along section line 5.

As best shown in FIG. 3, the endless belt 2 is supported laterally along its uppermost edges by a plurality of guide brackets 12 attached along its edges which engage two banks of support rollers 14 as they pass along the top edges of the frame 8. This view shows that the support rollers 14 are attached rigidly to the diagonally braced frame 8 so that any deflection downwards of the endless belt 2 is facilitated by using resilient materials such as rubber or other suitable material in the construction of the endless belt 2.

Figure 4:
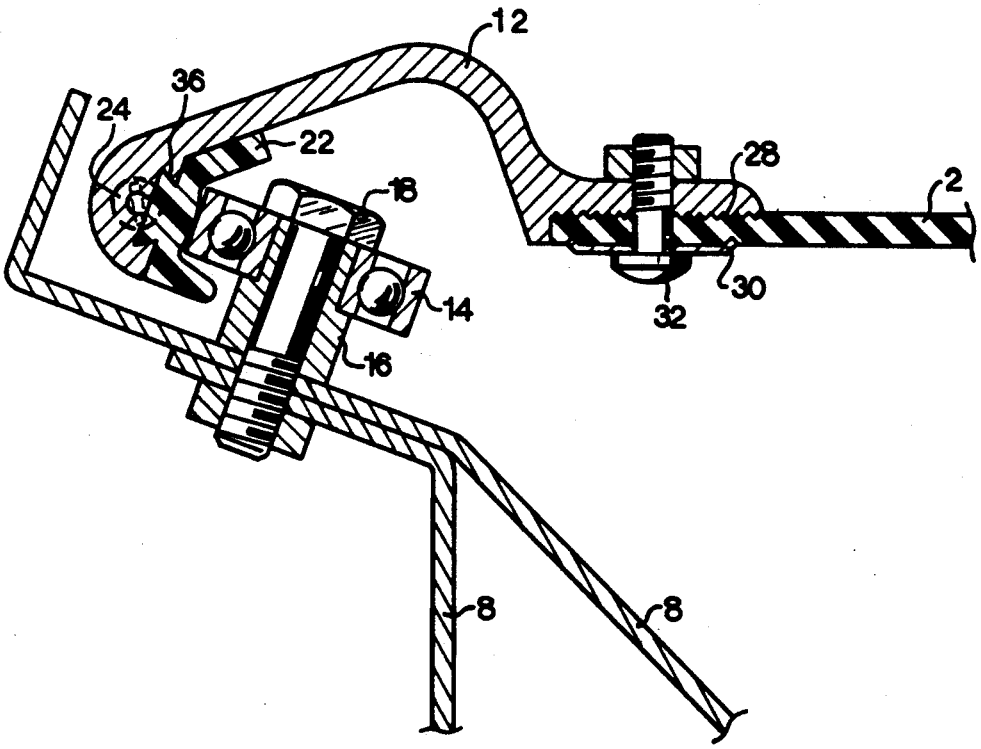
FIG. 4 is a partial view of the sectional view shown in FIG. 3 which better illustrates the construction of the lateral support rollers, guide brackets, and their attachments to the frame and endless belt respectively.

FIG. 4 best shows the preferred embodiment of a support roller 14 and guide bracket 12. The support rollers 14 are ball bearings 40 mm in diameter mounted in banks with 1.75 inch spacing between their centers. The guide brackets 12 are best fabricated as a segment of extruded aluminum cut to a length of 3 inches, so as to engage more than one roller 14 at a time.

A guide bushing 22 is fitted into the guide bracket 12 in a dovetail slot 36 and secured by two self-tapping screws 24, one on each end of the guide bracket 12. The guide bushings 22 are formed from a low friction plastic such as nylon or other suitable material also using the extrusion process. In fabricating the guide brackets 12 and guide bushings 22, the extrusion process allows for ideal profiles to be formed economically without expensive machining operations. A unique feature produced in the guide brackets 12 at no extra cost is the serrated section 28 which grips the edge of the endless belt 2 when clamped between the cupped washer 30 by bolt 32. With this method of attaching the guide brackets 12 to the endless belt 2, no grommet is required, further reducing the number of parts and operations to produce the present invention.

Aluminum is used in the guide brackets 12 for its light weight. This is to help reduce the forces that will act on the guide brackets 12 as they change directions on rollers 4,6, for greater mechanical efficiency and lower noise levels.

The guide brackets 12 could also be fabricated using the injection molding process from a suitably strong material such as nylon reinforced with glass fibers. These guide brackets would not need the extra guide bushings 22 or fasteners 24.

FIG. 4 also shows a support roller 14 in sectional view revealing it to be an unmodified ball bearing. Each support roller 14 is mounted rigidly to the frame 8 on a spacer 16 by a bolt 18. By mounting the support rollers 14 to the frame instead of on moving brackets as in prior art, a substantial increase in bearing size and load capacity can be made without increasing the weight of the moving parts.

A roller with a concave profile engaging a round continuous rail as shown in prior art, has a relatively high rolling resistance, because the roller can turn at only one speed relative to the continuous railing. A curved profile however, produces an infinite number of diameters within the range of the peak and trough of the curve, so that the area of the roller outside the line of contact that determines the speed of the roller is sliding as the roller turns. Lubricating oil is necessary to reduce the friction of this sliding area. The rollers 14 of the present invention have flat, smooth sides, and therefore no sliding area to reduce their mechanical efficiency.

Figure 5:
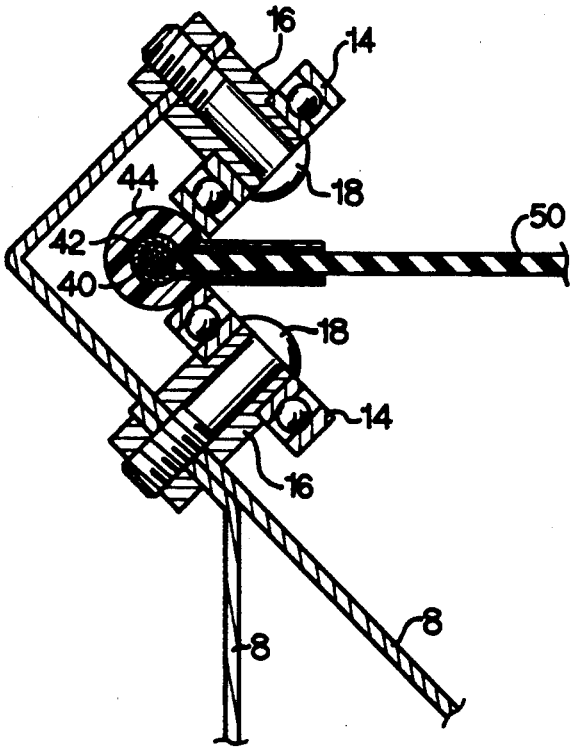
FIG. 5 is a sectional view of an alternate embodiment of the lateral support system of the present invention.

FIG. 5 shows an alternate embodiment of the present invention, in which the edges of a modified endless belt 50, are improved with a load-bearing profile. This profile is ideally built up from the edges of the endless belt 50, by attaching a multi-strand cable core 40 made from stainless steel or other suitable material, with a fabric reinforcing strip 42. A tubular plastic sleeve 44 made from a strong and flexible plastic, such as nylon is then bonded over the prepared edge of the endless belt 50 using a vulcanizing process to form a continuous, seamless load-bearing profile to engage the support rollers 14.

Figure 6:
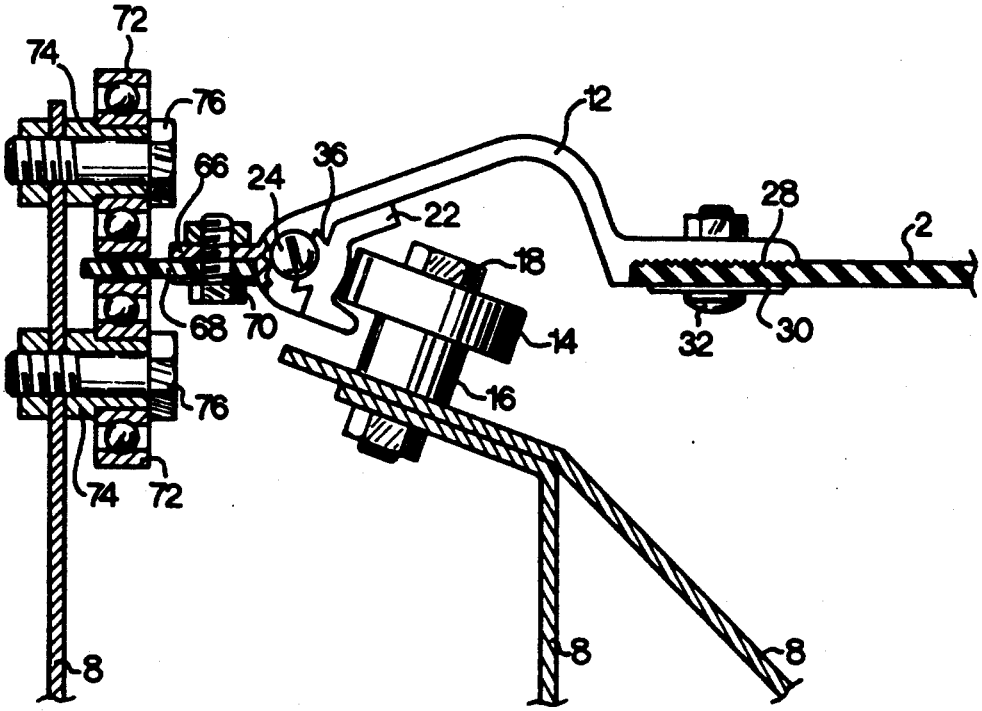
FIG. 6 is a view of the guide bracket of FIG. 4 with a sectional view of an additional guide feature and its connection to the guide brackets.

FIG. 6 shows an additional guide element added to the edges of the guide brackets 12. It is anticipated that at high speeds the guide brackets 12 might feed onto the support rollers 14 more efficiently if they are linked together by a flexible plastic strip 68. This strip 68, would align the guide brackets 12 with the support rollers 14 by passing between two feed rollers 72. A tab 66 would be formed onto the guide brackets 12 to allow them to be fastened to the plastic strip 68 by bolts 70. The feed rollers 72 would be attached to the frame 8 on spacers 74 by bolts 76.

In the featured prior art, most of the substantial noise of its operation (up to 80 decibels) is generated by the spring carrying roller brackets changing directions at the longitudinal support rollers. Decreasing the bend radius of the continuous rail increases the speed at which the roller brackets must change directions, resulting in greater friction, and higher noise levels. In the preferred embodiment of the present invention, the endless belt 2 changes directions around rollers 4,6 without forcing the guide brackets 12 to follow a rail as they travel with the belt 2. This removes the direct link of the diameter of the longitudinal support rollers to noise levels and mechanical efficiency, thus allowing the present invention to be built with smaller longitudinal support rollers 4,6 than would be practical using the featured prior art.

It is anticipated that the popular features of electric inclination and speed control can be provided as well as a comprehensive control panel to display information and to allow the user to change the settings for speed, inclination, and workout duration with the push of a button.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that a scope of the invention be limited not by this detailed description, but rather by the claims appended hereto.

What is claimed is:

1. A treadmill, comprising:

(a) an endless belt, with its uppermost surface exposed to form a flat exercise surface;

(b) a longitudinal support means located within the endless belt at each end of the exercise surface to suspend the endless belt and allow it to be moved longitudinally;

(c) a lateral support means located on either side of the uppermost surface of the endless belt for suspending the endless belt laterally from its edges within the area adapted for exercise;

(d) a connecting means along the edges of the endless belt for engaging the lateral support means as the endless belt moves relative to the lateral support means, wherein the connecting means include a plurality of guide brackets;

(e) a clamping means on the guide brackets for attaching the edge of the endless belt to the brackets, wherein the clamping means includes a washer means and an overlapping portion of the brackets, the overlapping portion including a gripping surface; and (f) a frame for maintaining the longitudinal and lateral support means in fixed positions relative to each other, the endless belt, and the ground on which the treadmill sits.

2. The treadmill of claim 1 wherein the longitudinal support means includes a pair of rotatable rollers.

3. The treadmill of claim 1, wherein the lateral support means includes two banks of rollers, each connected to the frame along a respective edge of the uppermost surface of the endless belt.

4. The treadmill of claim 3 wherein each roller comprises a ball bearing, and a spacer for allowing it to turn with its inner race connected to the frame.

5. The treadmill of claim 3, wherein the frame supports the two banks of rollers at a constant distance from each other, without direct structural bracing that might impede the downward deflection of the endless belt.

6. The treadmill of claim 1, wherein each bracket is formed as a segment of a metal or plastic extrusion.

7. The treadmill of claim 1, wherein each bracket is formed from injection molded plastic.

8. The treadmill of claim 1, wherein the edges of the endless belt are improved to form a continuous connecting means for engaging the lateral support means as the endless belt moves relative to the lateral support means.

* * * * *